US010863789B2

(12) United States Patent
Webb et al.

(10) Patent No.: US 10,863,789 B2
(45) Date of Patent: Dec. 15, 2020

(54) HIGH HEEL SHOE PROTECTOR

(71) Applicants: Vicki Webb, Upper Marlboro, MD (US); Charise Harper, Upper Marlboro, MD (US)

(72) Inventors: Vicki Webb, Upper Marlboro, MD (US); Charise Harper, Upper Marlboro, MD (US)

( * ) Notice: Subject to any disclaimer, the term of this patent is extended or adjusted under 35 U.S.C. 154(b) by 15 days.

(21) Appl. No.: 15/782,422

(22) Filed: Oct. 12, 2017

(65) Prior Publication Data

US 2018/0098599 A1 Apr. 12, 2018

Related U.S. Application Data

(60) Provisional application No. 62/407,146, filed on Oct. 12, 2016.

(51) Int. Cl.

| | |
|---|---|
| ***A43B 3/16*** | (2006.01) |
| ***A43B 1/00*** | (2006.01) |
| ***A41D 17/00*** | (2006.01) |
| ***A43B 3/24*** | (2006.01) |
| *A41D 13/06* | (2006.01) |

(52) U.S. Cl.

CPC ..... *A43B 3/16* (2013.01); *A43B 1/0081* (2013.01); *A43B 3/24* (2013.01); *A41D 13/06* (2013.01); *A41D 17/00* (2013.01)

(58) Field of Classification Search

CPC .... A43B 3/16; A43B 3/24; A43B 3/20; A43B 3/166; A43B 1/0081; A43B 23/00; A43B 23/30; A43B 5/007; A41D 13/06; A41D 17/00

USPC ..... D2/915; 36/1.5, 72 R, 72 B, 136

See application file for complete search history.

(56) References Cited

U.S. PATENT DOCUMENTS

| | | | | |
|---|---|---|---|---|
| 1,442,028 A * | 1/1923 | Phillips | ..... | A43B 5/007 36/72 B |
| 1,820,679 A * | 8/1931 | Sawyer | ..... | A43B 5/007 36/72 B |
| 1,834,551 A * | 12/1931 | Riley | ..... | A43B 3/16 36/7.3 |

(Continued)

FOREIGN PATENT DOCUMENTS

| | | | | |
|---|---|---|---|---|
| DE | 2654856 A1 * | 6/1978 | ..... | A43B 5/007 |
| DE | 3426293 A1 * | 1/1986 | ..... | A43B 23/30 |

(Continued)

*Primary Examiner* — Sharon M Prange
*Assistant Examiner* — Grace Huang
(74) *Attorney, Agent, or Firm* — Boudwin Intellectual Property; Daniel Boudwin

(57) ABSTRACT

A high heel shoe protector for covering and protecting an exterior surface of a high heel shoe. The high heel shoe protector includes a panel having a first distal end and a second distal end, wherein each distal end contains a fastener that removably secures to one another to form a front loop. The panel further contains a fold at a mid-section thereby creating a first lateral side and a second lateral side. A shared seam extends perpendicularly from a lower edge of each lateral side, wherein the seam creates a closed rear loop that receives a high heel of a high heel shoe. In an alternative embodiment, the panel is made of a flexible water resistant material and the fastener on each distal end comprises hook and loop material.

5 Claims, 4 Drawing Sheets

(56) References Cited

U.S. PATENT DOCUMENTS

| | | | | | |
|---|---|---|---|---|---|
| 2,033,935 | A * | 3/1936 | Griffith | A43B 3/16 | 36/7.3 |
| 2,215,880 | A * | 9/1940 | Lasley | A43B 3/16 | 24/389 |
| 2,449,115 | A * | 9/1948 | Harriman | A43B 1/0072 | 36/2 R |
| 2,763,938 | A * | 9/1956 | Alpern | A43B 5/007 | 36/72 B |
| 2,894,339 | A * | 7/1959 | Shapiro | A43B 5/007 | 36/72 B |
| 2,988,830 | A * | 6/1961 | Zacks | A43B 5/007 | 36/72 B |
| 3,025,617 | A * | 3/1962 | Rizzonelli | A43B 23/30 | 36/72 B |
| 3,104,479 | A * | 9/1963 | D'Amico | A43B 5/007 | 36/72 B |
| 4,713,895 | A | 12/1987 | Vallieres | | |
| 4,727,659 | A * | 3/1988 | Walker | A43B 5/007 | 24/16 PB |
| 5,062,223 | A | 11/1991 | Johnson | | |
| 5,890,302 | A | 4/1999 | Kirkis | | |
| 6,173,448 | B1 | 1/2001 | Kroposky | | |
| 2005/0034221 | A1 | 2/2005 | Ridpath et al. | | |
| 2008/0018066 | A1* | 1/2008 | Pickford | A43B 3/0005 | 280/11.3 |
| 2008/0047169 | A1* | 2/2008 | Hoch | A43B 1/0081 | 36/2 R |
| 2008/0155863 | A1* | 7/2008 | Shor | A41D 17/00 | 36/2 R |
| 2013/0097893 | A1 | 4/2013 | Rabinovitch | | |
| 2013/0161123 | A1* | 6/2013 | Morgan | E04B 1/84 | 181/175 |
| 2015/0128457 | A1* | 5/2015 | Wright | A43B 3/16 | 36/72 B |

FOREIGN PATENT DOCUMENTS

| | | | | |
|---|---|---|---|---|
| DE | 102006047906 | A1 * | 4/2008 | A43B 5/007 |
| FR | 2642278 | A3 * | 8/1990 | A43B 23/30 |
| GB | 2118427 | A * | 11/1983 | A43B 23/30 |
| GB | 2223157 | A * | 4/1990 | A43B 5/007 |

* cited by examiner

HIGH HEEL SHOE PROTECTOR

CROSS REFERENCE TO RELATED APPLICATION

This application claims the benefit of U.S. Provisional Application No. 62/407,146 filed on Oct. 12, 2016. The above identified patent application is herein incorporated by reference in its entirety to provide continuity of disclosure.

BACKGROUND OF THE INVENTION

The present invention relates to shoe covers. More specifically, the present invention provides a high heel shoe protector configured to protect a high heel shoe from scuffs, scratches, and unappealing marks.

High heel shoes are as much about fashion as they are functionality. Many people spend hundreds or even thousands of dollars on designer high heel shoes just to show them off in public. Price notwithstanding, these high heel shoes will suffer wear and tear like any shoe with prolonged use over time. While shoes may be stored in protective bags or cases when in storage, covering the shoe while in use is not typically done. In many instances, the wearer only wants to show off the fashionable heels while walking about.

However, while performing everyday tasks, such as driving a car, high heel shoes are not seen. Furthermore, while driving a car high heel shoes have a propensity to become scuffed or marked with unattractive black marks as a result of the driver constantly using their feet to press the pedals. In many cases when going from brake pedal to gas pedal, a user wearing a pair of high heel shoes will accidently strike the outer surface of the shoe causing a scuff or an unattractive mark. This can potentially ruin an expensive high heel shoe. In other instances, a user may be wearing high heels and unforeseen weather, such as a rainstorm, may occur. In such a situation, the user may have to remove the shoes in order to protect them. This can be quite cumbersome to do. Therefore, a device that can protect the outer surface of a high heel shoe from scuffs, scratches, water and debris while being worn is needed.

Devices have been disclosed in the known art that relate to protective covers for shoes. These include devices that have been patented and published in patent application publications. These devices generally relate to covers that protect a user's limbs and shoes from being subjected to specific wear and tear. One protective cover is used to protect the user's limb from being struck by a plastic cord of a weed trimmer while performing yard work. Other shoe covers are disposable and protect the shoe from being saturated with dirt and grime. While some shoe covers serve merely decorative purposes.

These prior art devices have several known drawbacks. Specifically, these protective shoe covers are not configured for use with a high heel shoe. Many of these devices lack the length and width to accommodate the pointed heel of a high heel shoe. Further these protective shoe covers fail to include an opening where the high heel of the high heel shoe can be received through. Finally, many of these devices are flimsy and meant to be disposable, such that they only protect against light dirt or muck, and fail to include a durable material that can prevent scratches. Accordingly, a device designed to protect a high heel shoe from scuffs, scrapes, and debris while being worn is desired.

In light of the devices disclosed in the known art, it is submitted that the present invention substantially diverges in design elements from the known art and consequently it is clear that there is a need in the art for an improvement to existing shoe covering devices. In this regard the instant invention substantially fulfills these needs.

SUMMARY OF THE INVENTION

In view of the foregoing disadvantages inherent in the known types of shoe covers now present in the prior art, the present invention provides a new high heel shoe protector wherein the same can be utilized for providing convenience for the user when protecting a high heel shoe from scratches and scuffs incurred from daily use.

It is therefore an object of the present invention to provide a new and improved high heel shoe protector that has all of the advantages of the prior art and none of the disadvantages.

It is another object of the present invention to provide a high heel shoe protector comprising a panel having a first distal end and second distal end, wherein each distal end contains a fastener configured to removably secure to one another to form a front loop, wherein the front loop extends from a front portion of the high heel shoe to a rear portion of the high heel shoe. The device further includes a fold at a mid-section of the panel creating a first lateral side and a second lateral side, wherein the fold is curved such that it rests flush against a heel end of a high heel shoe and a seam extending perpendicularly from a lower edge to a central point on each lateral side, wherein the seam and the fold create a closed rear loop therebetween. The closed rear loop is configured to receive a high heel of the high heel shoe. A perimeter edge of the lower opening of the front loop defines a first plane, and wherein a perimeter edge of the open lower end of the closed rear loop defines a second plane, such that the first plane and the second plane are in a common plane with each other. The central point is disposed at at least a third of the width of the panel from the lower edge of each lateral side, such that the width is measured from the top edge of the panel to the lower edge of the panel. The seam is offset from a midpoint of each lateral side towards the fold.

Another object of the present invention is to provide a high heel shoe protector, wherein the fastener of each distal end comprises hook and loop material disposed on opposing surfaces of the panel.

Yet another object of the present invention is to provide a high heel shoe protector, wherein the panel is made of a flexible material that is water resistant.

Another object of the present invention is to provide a high heel shoe protector that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
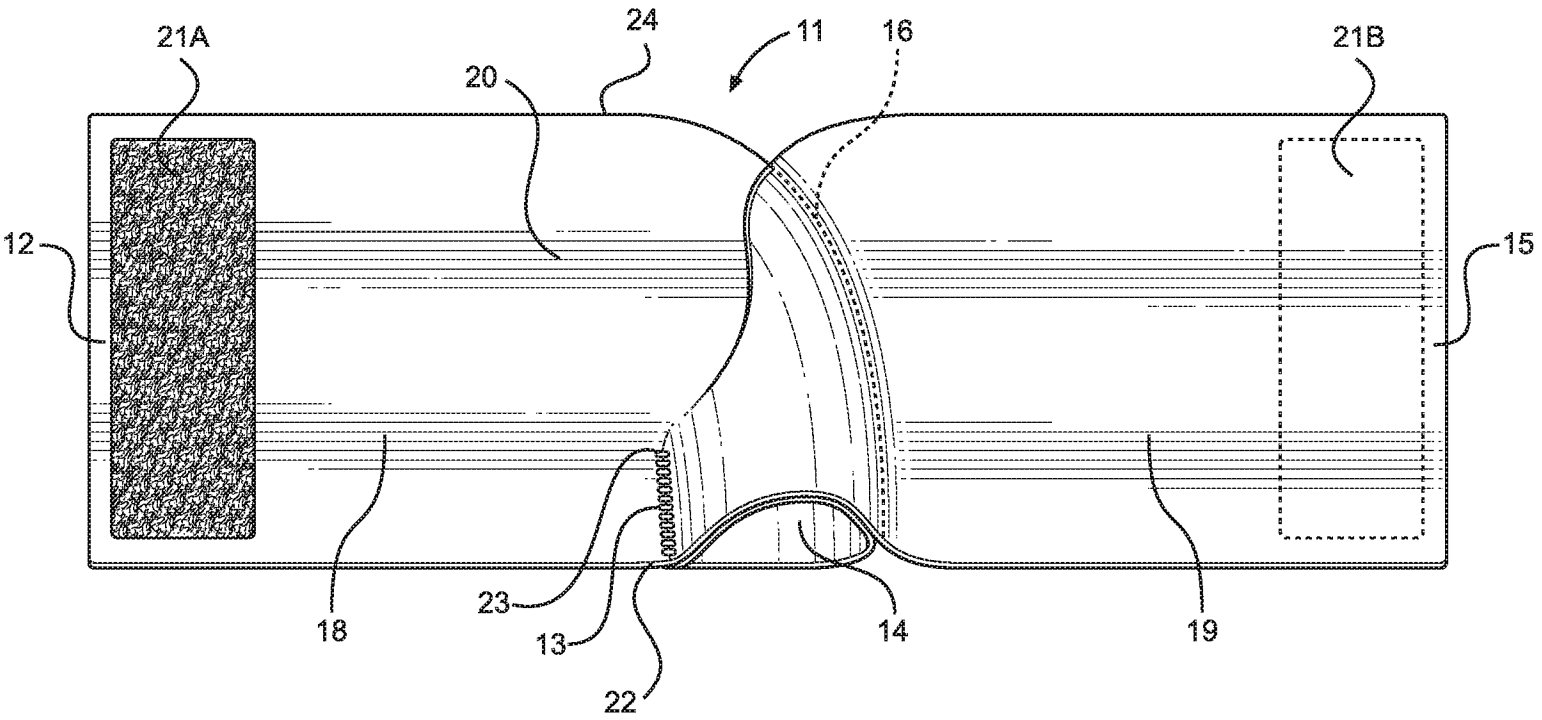
FIG. 1 shows a perspective view of an embodiment of the high heel shoe protector.

Reference is made herein to the attached drawings. Like reference numerals are used throughout the drawings to depict like or similar elements of the high heel shoe protector. For the purposes of presenting a brief and clear description of the present invention, the preferred embodiment will be discussed as used for protecting the outer surface of a high heel shoe from scuffs, scratches, and debris. The figures are intended for representative purposes only and should not be considered to be limiting in any respect.

Referring now to FIG. 1, there is shown a perspective view of an embodiment of the high heel shoe protector. The high heel shoe protector 11 comprises a panel 20 having a first distal end 12 and a second distal end 15, wherein each distal end 12, 15 contains a fastener 21A, 21B configured to removably secure to one another to form a front loop. The front loop is configured to receive a substantial front portion of a high heel shoe therein. The panel 20 further includes a fold 16 at a mid-section of the panel 20, wherein the mid-section is defined as an equal distance between the distal ends 12, 15 of the panel 20. The fold creates a first lateral side 18 and a second lateral side 19, wherein the fold 16 is curved such that it rests flush against a heel end of a high heel shoe, when in an attached position.

Each lateral side 18, 19 is substantially rectangular, however, in alternative embodiments the lateral sides may be any shape, such as curved, to accommodate different types of high heel shoes. In some embodiments, the fold 16 is offset toward one of the distal ends 12, 15, such that one of the lateral sides 18, 19 is longer in length than the other. In the illustrated embodiment, the first lateral side 18 and second lateral side 19 include a shared seam 13 that extends perpendicularly from a lower edge 22 of each lateral side 18, 19 to a central point 23 on each lateral side 18, 19, wherein the shared seam 13 and the fold 16 create a closed rear loop 14 therebetween. The closed rear loop 14 is configured to receive a high heel of the high heel shoe.

In the illustrated embodiment, the central point 23 is disposed at least a third of the width of the panel 20 from the lower edge 22 of each lateral side 18, 19, such that the width is measured from a top edge 24 of the panel 20 to the lower edge 22 of the panel. The length of the shared seam 13 is integral with the high heel such that it provides more protective coverage to the heel. The length of the seam 13 also creates a more secure closed rear loop 14 that is less likely to become undone during use. Further, the shared seam 13 is disposed offset from a midpoint of each lateral side 18, 19 towards the fold 16 of the panel 20. The offset of the shared seam 13 positions the rear closed loop 14 towards the heel end of the high heel shoe when in the attached position, such that the closed rear loop can receive the high heel of the high heel shoe. The offset position further creates a smaller closed rear loop that is sized to receive the high heel.

Figure 2A:
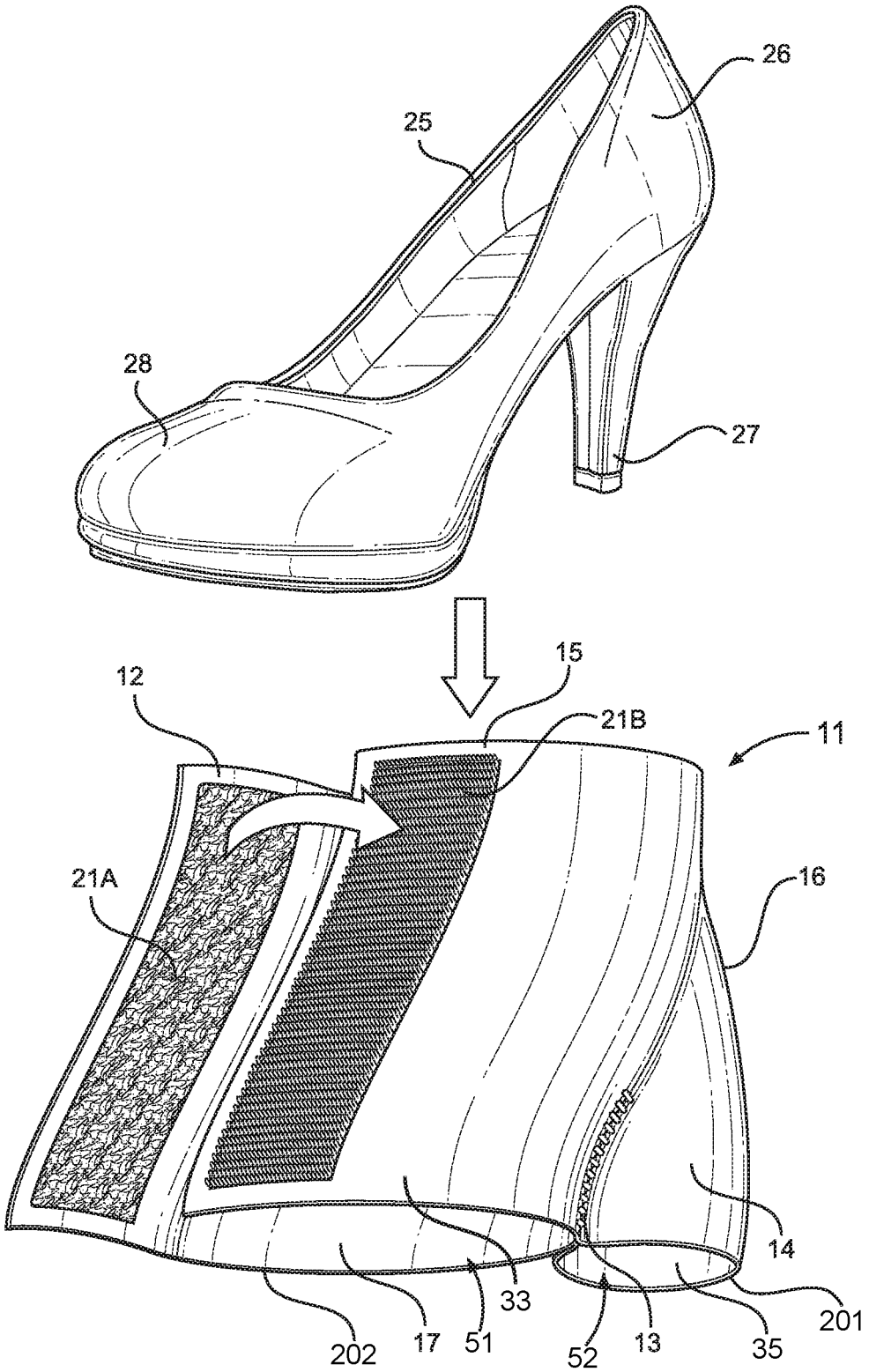
FIG. 2A shows a perspective view of an embodiment of the high heel shoe protector in a detached position.
Figure 2B:
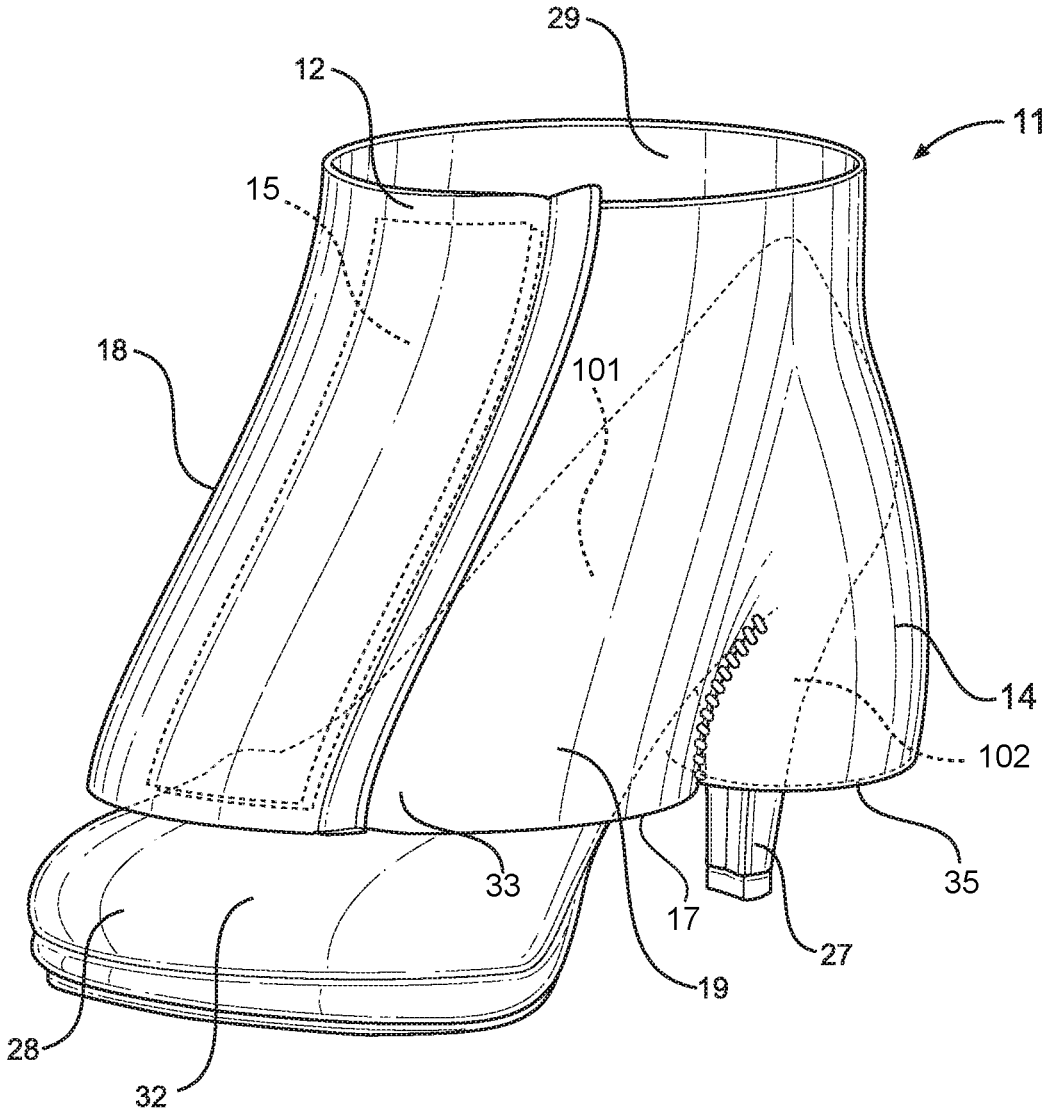
FIG. 2B shows a perspective view of an embodiment of the high heel shoe protector in an attached position.

Referring now to FIG. 2A and FIG. 2B, there is shown a perspective view of an embodiment of the high heel shoe protector in a detached position and an embodiment of the high heel shoe protector in an attached position, respectively. In the illustrated embodiment, the fold 16 of the panel is configured to rest flush with the heel end 26 of the high heel shoe 25. When in the attached position, the heel end 26 is aligned within the center of the fold 16 wherein the curved material of the fold 16 rests against the outer surface of the heel end 26. The flush fit prevents movement of the device while in use and further protects the surface of the shoe by placing the panel in direct contact over the shoe. Further, when in the attached position, the closed rear loop 14 is configured to receive and secure the high heel 27 of the shoe therein.

The high heel shoe protector 11 includes fasteners 21A, 21B disposed on opposing surfaces of the panel 20. This configuration allows the second distal end 15 to fold over a front portion 101 of the high heel shoe 25, wherein the first distal end 12 can be removably secured to the second distal end 15. Once secured, a first upper opening 29 is configured to receive a lower leg of a user, a second lower opening 17 of the front loop 33 is configured to receive a toe end 28 of the high heel shoe 25, and a third lower opening 35 of the closed rear loop 14 receives the high heel 27 of the high heel shoe 25. When in the attached position, the first lateral side 18 and second lateral side 19 of the panel are configured to cover a substantial portion of the high heel shoe 25. The high heel shoe 25 can be described as having a front portion 101 and a rear portion 102, such that front loop 33 extends from the front portion 101 of the high heel shoe 25 to the rear portion 102 of the high heel shoe 25, as shown in FIG. 2B. As shown in FIGS. 2A and 2B, a first perimeter edge 202 of the lower opening 17 of the front loop 33 forms a first plane 51, and a second perimeter edge 201 of the lower opening 35 of the closed rear loop 14 forms a second plane 52. The first plane 51 and the second plane 52 are in a common plane with each other and aligned to facilitate the substantial covering of the front and rear portions 101, 102 of the high heel shoe 25, as shown in FIG. 2B. When in the attached position, the high heel shoe protector 11 prevents an outer surface 32 of the high heel shoe 25 from being subjected to scrapes and scuffs from everyday use. In the illustrated embodiment, the fasteners 21A, 21B comprise hook and loop material. However, in alternative embodiments, the fasteners can be any type of fastener, such as, buttons, zippers, or clasps.

Figure 3:
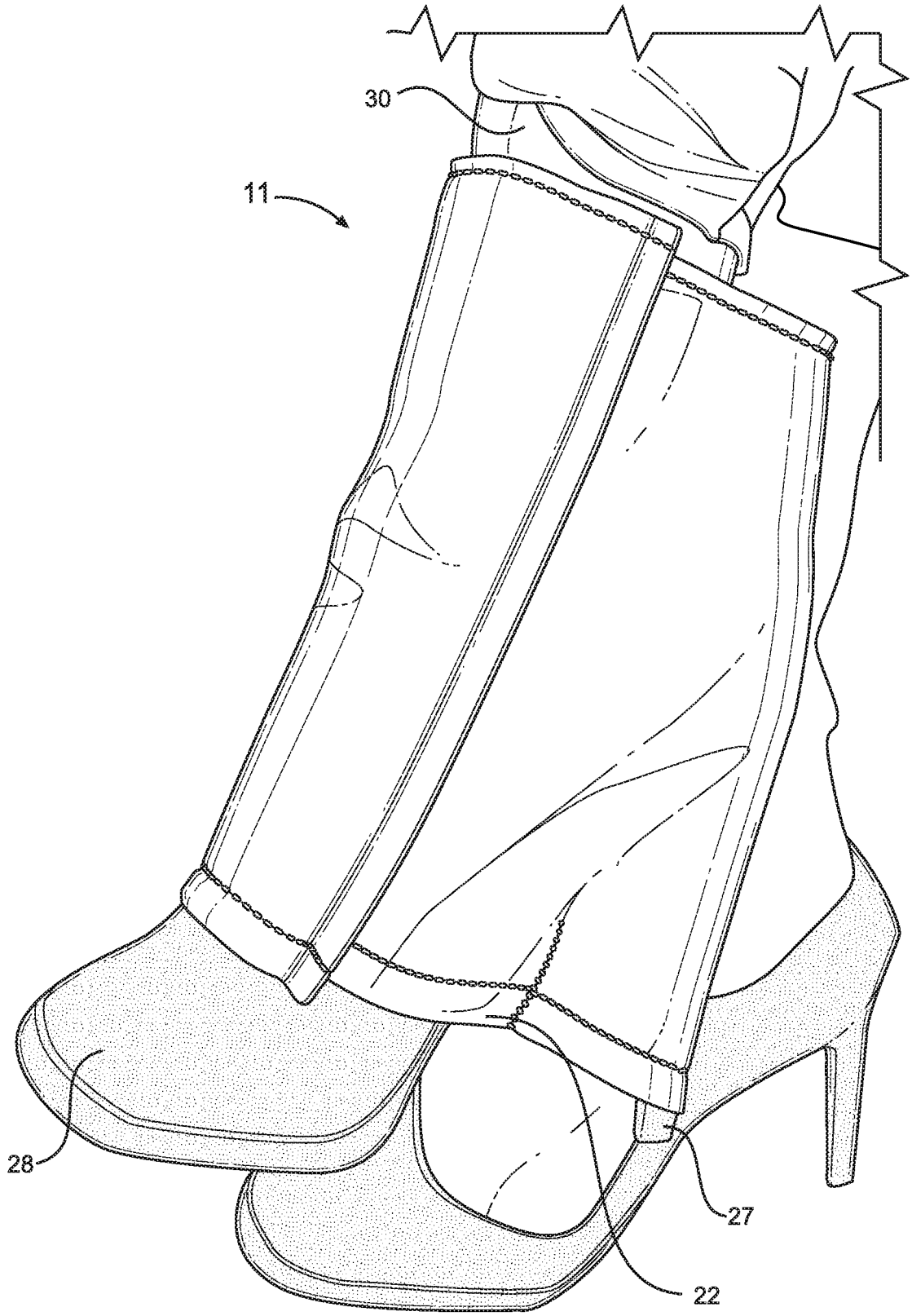
FIG. 3 shows a perspective view of an embodiment of the high heel shoe protector, wherein the device is in an attached position on a lower leg of a user.

Referring now to FIG. 3, a perspective view of an embodiment of the high heel shoe protector, wherein the high heel shoe protector is in an attached position on a lower leg of a user. In the illustrated embodiment, the lower edge 22 of the panel is configured to rest just above the high heel 27 of the high heel shoe when in the attached position on a lower leg 30 of a user. This prevents the high heel shoe protector 11 from becoming saturated with dirt or debris during use. Further, the toe end 28 of the high heel shoe remains partially exposed because the lower edge 22 of the device 11 is configured to rest thereon. This prevents the lower edge 22 from touching the ground during use.

In the illustrative embodiment, the high heel shoe protector 11 is constructed of a flexible material, such that it can be wrapped around the high heel shoe. In some embodiments, the flexible material is water resistant to prevent saturation of the material during wet conditions. In the illustrated embodiment, only one high heel shoe protector 11 is shown to better illustrate the function of the device while on a user. However, during everyday use, a user would wear a high heel shoe protector 11 on both legs 30 to protect each individually worn high heel shoe. The high heel shoe protector 11 is configured for use for both a right and a left high heel shoe.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A high heel shoe protector, comprising:

a panel having a first distal end and a second distal end, wherein each distal end contains a fastener configured to removably secure to one another to form a front loop having an upper opening and a lower opening, wherein the front loop is configured to extend from a front portion of a high heel shoe to a rear portion of the high heel shoe;

a fold at a mid-section of the panel creating a first lateral side and a second lateral side, wherein the fold is curved such that it is configured to rest flush against a heel end of the high heel shoe; and a seam extending perpendicularly from a lower edge of each lateral side to a point on each lateral side positioned below a top edge of each lateral side, wherein the seam and the fold create a closed rear loop therebetween, the closed rear loop comprising an open lower end through which the heel portion of the high heel shoe can extend;

wherein the first distal end and the second distal end of the panel each connect to the seam, such that the first distal end and the second distal end of the panel extend forward from the seam;

wherein a perimeter edge of the lower opening of the front loop defines a first plane, and wherein a perimeter edge of the open lower end of the closed rear loop defines a second plane, such that the first plane and the second plane are in a common plane with each other.

2. The high heel shoe protector of claim 1, wherein the fastener of each distal end comprises hook and loop material.

3. The high heel shoe protector of claim 2, wherein the hook and loop material are on opposing surfaces of the panel.

4. The high heel shoe protector of claim 1, wherein the fold is offset toward one of the distal ends of the panel, such that the first lateral side comprises a length that is greater than a length of the second lateral side.

5. A method of attaching a high heel shoe protector to a high heel shoe, comprising:

placing a high heel of a high heel shoe within a closed rear loop of a high heel shoe protector, such that the high heel extends through an open lower end of the closed rear loop, the high heel shoe protector comprising:

a panel having a first distal end and a second distal end, wherein each distal end contains a fastener configured to removably secure to one another to form a front loop having an upper opening and a lower opening, wherein the front loop extends from a front portion of the high heel shoe to a rear portion of the high heel shoe;

a fold at a mid-section of the panel creating a first lateral side and a second lateral side, wherein the fold is curved such that it rests flush against a heel end of the high heel shoe; and a seam extending perpendicularly from a lower edge of each lateral side to a point on each lateral side positioned below a top edge of each lateral side, wherein the seam and the fold create a closed rear loop therebetween, the closed rear loop comprising an open lower end through which the high heel portion of the high heel shoe can extend;

wherein the first distal end and the second distal end of the panel each connect to the seam, such that the first distal end and the second distal end of the panel extend forward from the seam;

wherein a perimeter edge of the lower opening of the front loop defines a first plane, and wherein a perimeter edge of the open lower end of the closed rear loop defines a second plane, such that the first plane and the second plane are in a common plane with each other;

placing the second distal end of the high heel shoe protector over an upper portion of the high heel shoe;

aligning the fastener on the first distal end of the high heel shoe protector with the fastener on the second distal end;

securing the fastener on the first distal end to the fastener on the second distal end to form the front loop around the front portion of the high heel shoe.

* * * * *